US008173916B2

(12) United States Patent
Kim

(10) Patent No.: US 8,173,916 B2
(45) Date of Patent: May 8, 2012

(54) MOVE-OUT TYPE INTERLOCK APPARATUS FOR CIRCUIT BREAKER

(75) Inventor: Dae Seong Kim, Chungcheongbuk-Do (KR)

(73) Assignee: LS Industrial Systems Co., Ltd., Gyeonggi-Do (KR)

( * ) Notice: Subject to any disclaimer, the term of this patent is extended or adjusted under 35 U.S.C. 154(b) by 276 days.

(21) Appl. No.: 12/641,769

(22) Filed: Dec. 18, 2009

(65) Prior Publication Data

US 2010/0294629 A1 Nov. 25, 2010

(30) Foreign Application Priority Data

May 21, 2009 (KR) ..... 10-2009-0044690

(51) Int. Cl.
*H01H 9/20* (2006.01)

(52) U.S. Cl. ..... 200/50.24

(58) Field of Classification Search ..... 200/50.24, 200/50.21, 401; 361/609, 615
See application file for complete search history.

(56) References Cited

U.S. PATENT DOCUMENTS

| | | | | |
|---|---|---|---|---|
| 3,400,353 | A | 9/1968 | Schockelt | |
| 4,516,100 | A | 5/1985 | Wallace et al. | |
| 4,728,757 | A * | 3/1988 | Buxton et al. | 200/50.21 |
| 5,508,670 | A | 4/1996 | Mantzouridis et al. | |
| 5,628,394 | A * | 5/1997 | Benke et al. | 200/400 |
| 5,719,363 | A | 2/1998 | Handler | |
| 5,864,109 | A | 1/1999 | Ahn | |
| 6,031,192 | A * | 2/2000 | Liebetruth | 200/50.21 |
| 6,545,859 | B2 * | 4/2003 | Leccia | 361/607 |
| 6,787,725 | B2 | 9/2004 | Kim et al. | |
| 6,884,949 | B2 | 4/2005 | Yoon | |
| 7,227,279 | B2 | 6/2007 | Kim | |
| 7,964,809 | B2 * | 6/2011 | Sapuram et al. | 200/50.21 |
| 2005/0140477 | A1 | 6/2005 | Germain et al. | |

FOREIGN PATENT DOCUMENTS

| | | |
|---|---|---|
| DE | 29506151 | 6/1995 |
| DE | 10006427 | 8/2001 |
| EP | 0035083 | 9/1981 |
| EP | 1507275 | 2/2005 |

OTHER PUBLICATIONS

Search report from E.P.O., mail date is Aug. 2010.
U.S. Appl. No. 12/633,827 to Park, filed Dec. 9, 2009.
U.S. Appl. No. 12/633,863 to Kim et al., filed Dec. 9, 2009.
U.S. Appl. No. 12/635,911 to Woo, filed Dec. 11, 2009.
U.S. Appl. No. 12/641,946 to Seo, filed Dec. 18, 2009.
U.S. Appl. No. 12/645,783 to Kim, filed Dec. 23, 2009.
U.S. Appl. No. 12/645,620 to Kim et al., filed Dec. 23, 2009.
U.S. Appl. No. 12/651,501 to Tak et al., filed Jan. 4, 2010.

* cited by examiner

*Primary Examiner* — Vanessa Girardi
(74) *Attorney, Agent, or Firm* — Greenblum & Bernstein, P.L.C.

(57) ABSTRACT

Disclosed is an interlock apparatus for a move-out type circuit breaker, capable of automatically discharging elastic energy charged in a closing spring and a trip spring when a main body of the circuit breaker is moved-in or moved-out, the apparatus including, a releasing protrusion member fixed to a predetermined position on a path that the circuit breaker is moved-in or moved-out and protruded upwardly from the predetermined position, an automatic releasing mechanism configured to be moved up by coming in contact with the releasing protrusion member upon moved-in or moved-out the circuit breaker to thereby drive a latching mechanism for latching the closing spring and the trip spring in a charged state to the release position.

9 Claims, 18 Drawing Sheets

MOVE-OUT TYPE INTERLOCK APPARATUS FOR CIRCUIT BREAKER

CROSS-REFERENCE TO A RELATED APPLICATION

Pursuant to 35 U.S.C. §119(a), this application claims the benefit of earlier filing date and right of priority to Korean Application No. 10-2009-0044690, filed on May 21, 2009, the contents of which is incorporated by reference herein in its entirety.

BACKGROUND OF THE INVENTION

1. Field of the Invention

The present invention relates to a circuit breaker, and particularly, to an interlock apparatus for a move-out type circuit breaker capable of automatically discharging elastic energy charged in a closing spring and a trip spring upon moved-in or moved-out a main body of the circuit breaker.

2. Background of the Invention

A circuit breaker is a device for automatically detecting an occurrence of fault current on a circuit and breaking the circuit accordingly, thereby protecting lives, circuits and electric load equipment from electrical power accident. The circuit breakers may be classified, according to the size of a rated voltage of electric power used, into a low voltage circuit breaker lower than several hundred volts and a high voltage circuit breaker higher than that.

The present invention relates to an interlock apparatus applicable to a vacuum circuit breaker used as a high voltage circuit breaker among others, and a low voltage air circuit breaker. Compared to a stationary type circuit breaker, the move-out type circuit breaker is a circuit breaker in which a main body of the circuit breaker is separated from a terminal of an outer casing connected to an external power source side circuit and an external electrical load side circuit via terminals, in order to test, repair (maintain) and replace the main body, and then the separated main body is carried to a move-out position, or to a move-in position, at which the main body is connected to the terminal of the outer casing, after completion of the testing, repair and replacement. For the move-out and move-in, transfer wheels are disposed at a lower portion of the main body together with a driving device for the move-out and move-in. The move-out type circuit breaker is globally used in an electric power system due to its stability and convenience upon testing, repairing and replacing the circuit breaker main body as compared to the stationary type circuit breaker.

Further, the move-out type circuit breaker may have a closed position (or so-called on-position) at which a circuit is closed to allow electrical power supply and an open position (or so-called off-position or trip position) at which a circuit is open to break off power supply. The driving (guiding) of the move-out type circuit breaker toward the closed position and the open position is performed by using a force generated when discharging elastic energy, which is charged by tensioning a closing spring and a trip spring, respectively. Upon an occurrence of fault current on a circuit, since it is needed to instantaneously break off the circuit, a substantially great elastic energy of the closing spring and the trip spring is required.

In such move-out type circuit breaker, in order to repair (maintain) or replace the circuit breaker, the main body of the circuit breaker may be moved-out of a connected position with a terminal on the outer casing or moved-in to a connected position with the terminal on the outer casing after the repair or replacement. When pushing in or pulling out the circuit breaker main body, if the closing spring or the trip spring of the circuit breaker is in a state of elastic energy being charged therein, such elastic energy charged in the closing spring or the trip spring may be discharged during operation, causing the chance of incurring risk.

SUMMARY OF THE INVENTION

Therefore, an object of the present invention is to provide an interlock apparatus for a move-out type circuit breaker capable of protecting user's safety by automatically discharging an elastic energy charged in a closing spring and/or a trip spring in interlocking with an operation of moving-in (retracting) or moving-out (withdrawing) the circuit breaker in case where a main body of the circuit breaker is moved-out of a connected position with a terminal on an outer casing or moved-in to a connected position with the terminal on the outer casing.

To achieve these and other advantages and in accordance with the purpose of the present invention, as embodied and broadly described herein, there is provided an interlock apparatus for a move-out type circuit breaker, provided with a closing spring and a trip spring each for providing elastic energy for opening and closing a circuit, and a latching mechanism movable to a latching position where the closing spring and the trip spring are latched so as to remain in a charged state and a release position where the closing spring and the trip spring are released to discharge the charged elastic energy, the move-out type circuit breaker having a move-in position and a move-out position, the interlock apparatus including: a releasing protrusion member fixed to a predetermined position to be upwardly protruded on a path to move-out or move-in the circuit breaker; and an automatic releasing mechanism supported at the circuit breaker to be vertically movable, and configured to be moved up by coming in contact with the releasing protrusion member upon moving-in or moving-out the circuit breaker to thereby drive the latching mechanism to the release position.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIGS. 8 to 18 are views showing operations of an automatic releasing mechanism, a power transfer mechanism and a trip latch of the interlock apparatus for the circuit breaker according to the present invention, wherein FIG. 8 is a status view showing an initial state of an operation in case where the vacuum circuit breaker is closed state (i.e., ON state) and a closing spring is charged;

FIG. 9 is a status view showing an intermediate state of the operation in case where the vacuum circuit breaker is closed and the closing spring is charged;

FIG. 10 is a status view showing a completed state of the operation in case where the vacuum circuit breaker is closed and the closing spring is charged;

FIG. 11 is a status view showing an initial state of an operation in case where the vacuum circuit breaker is closed and the closing spring is discharged;

FIG. 12 is a status view showing an intermediate state of the operation in case where the vacuum circuit breaker is closed and the closing spring is discharged;

FIG. 13 is a status view showing a completed state of the operation in case where the vacuum circuit breaker is closed and the closing spring is discharged;

FIG. 14 is a status view showing an initial state of an operation in case where the vacuum circuit breaker is tripped (broken, i.e., OFF state) and the closing spring is charged;

FIG. 15 is a status view showing an intermediate state of the operation in case where the vacuum circuit breaker is tripped and the closing spring is charged;

FIG. 16 is a status view showing an intermediate state of the operation performed further than the state shown in FIG. 15 in case where the vacuum circuit breaker is tripped and the closing spring is charged;

FIG. 17 is a status view showing a completed state of the operation in case where the vacuum circuit breaker is tripped and the closing spring is charged; and FIG. 18 is a status view showing an operation state in case where the vacuum circuit breaker is tripped and the closing spring is discharged.

DETAILED DESCRIPTION OF THE INVENTION

Description will now be given in detail of the present invention, with reference to the accompanying drawings.

Figure 1:
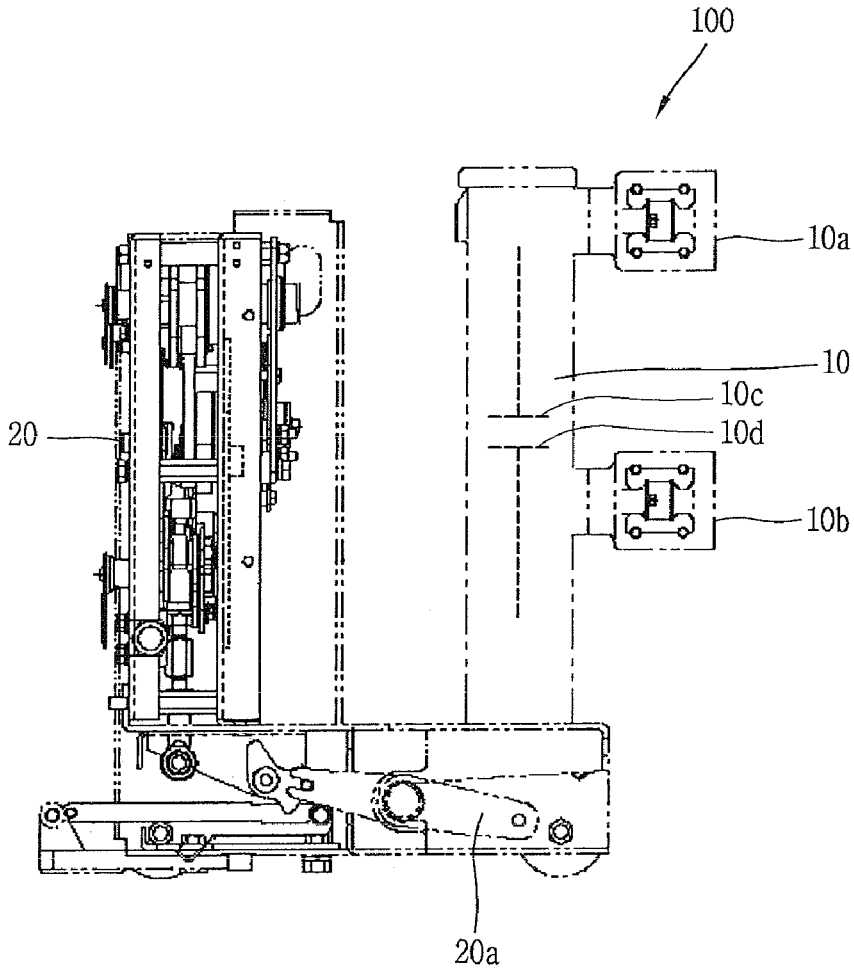
FIG. 1 is a side view showing an overview of an outer appearance of a vacuum circuit breaker in accordance with an embodiment to which the present invention is applicable.

FIG. 1 is a side view showing an overview of an outer appearance of a vacuum circuit breaker, to which a move-out type interlock apparatus for a circuit breaker is applicable, according to the present invention. A typical construction of a vacuum circuit breaker will be described with reference to FIG. 1.

As shown in FIG. 1, a vacuum circuit breaker 100 may include a switching mechanism 20, a main circuit section 10, and upper and lower terminals 10*a* and 10*b*.

The switching mechanism 20 is a driving mechanism for generating a driving force for opening or closing a circuit of the vacuum circuit breaker 100. The switching mechanism 20 may include a closing spring for providing an elastic driving energy to close a circuit, which will be explained later, a trip spring for providing an elastic energy to open (break off, trip) the circuit, and a latching mechanism movable to a latching position for latching the closing spring and the trip spring such that the closing spring and the trip spring can be maintained in a charged state, and a release position for releasing the closing spring and the trip spring such that the springs can be discharged. At a front surface of the switching mechanism 20 may be provided an actuator for actuating the vacuum circuit breaker 100 to an ON (or closing) position or an OFF (or opening) position, an overcurrent relay for detecting an abnormal status of a circuit and controlling the switching mechanism 20 to be moved to a trip position, a display for displaying a current position (e.g., ON position, OFF position, trip position) of the circuit breaker, and the like.

The main circuit section 10 may include a vacuum interrupter, a power transfer rod connected to a movable contactor of the vacuum interrupter, and the like.

The upper and lower terminals 10*a* and 10*b* may be connected electrically and mechanically to a movable contactor 10*d* and a stationary contactor 10*c* of the vacuum interrupter of the main circuit section 10, respectively. The upper and lower terminals 10*a* and 10*b* may be connected to a power source circuit and an electrical load circuit, respectively, at a retraction position of the vacuum circuit breaker 100.

Reference numeral 20*a* in FIG. 1 designates a power transfer link for transferring power for opening and closing a circuit of the switching mechanism 20 to the main circuit section 10.

Figure 4:
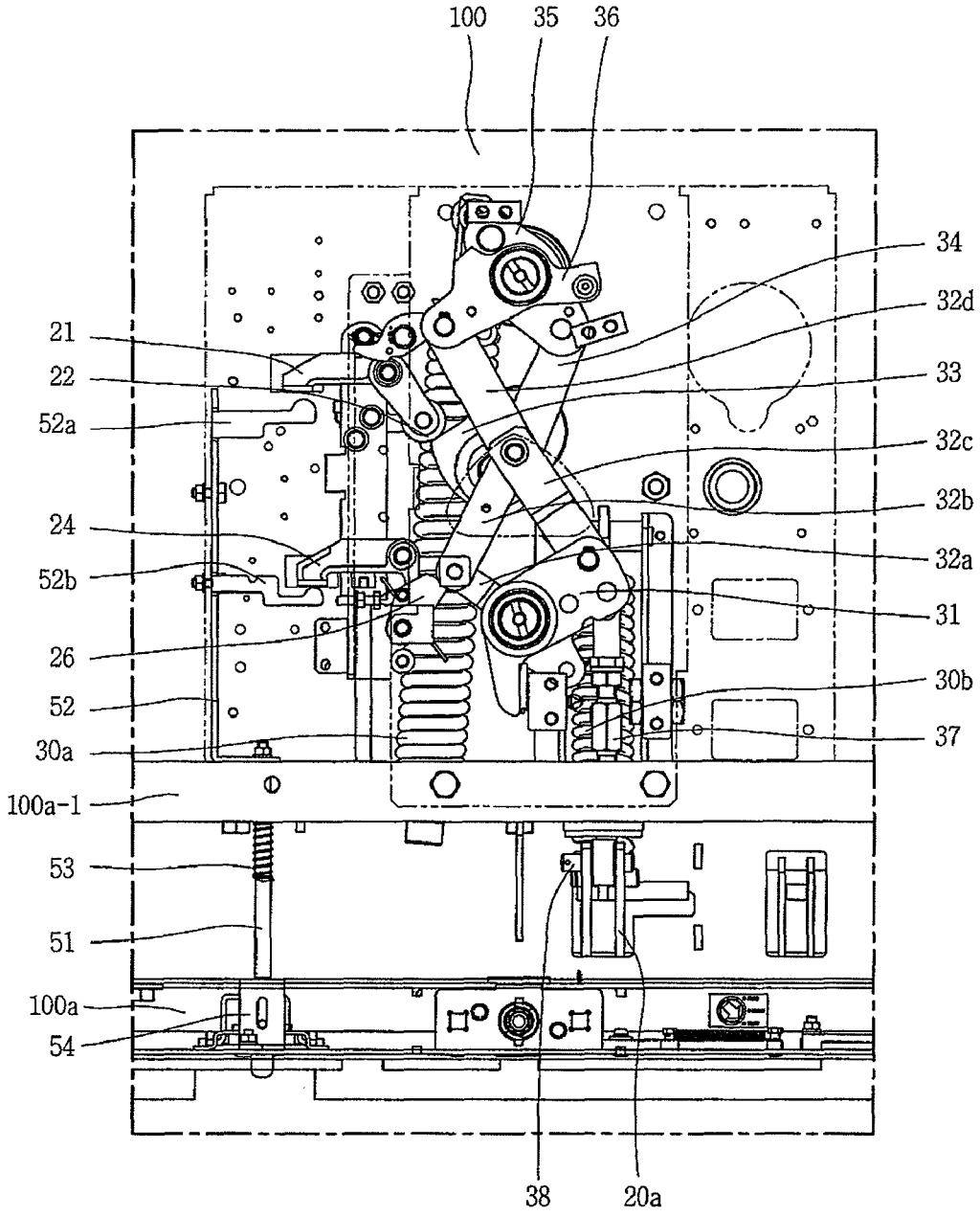
FIG. 4 is a front view showing the configuration of a vacuum circuit breaker having a move-out type interlock apparatus according to the present invention.

As stated above, the vacuum circuit breaker 100 may be supported by a support frame (see 100*a* in FIG. 4). Typically four wheels for allowing the vacuum circuit breaker 100 to be moved to a move-out position or move-in position may be rotatably installed at a lower portion of the support frame 100*a*.

Figure 2:
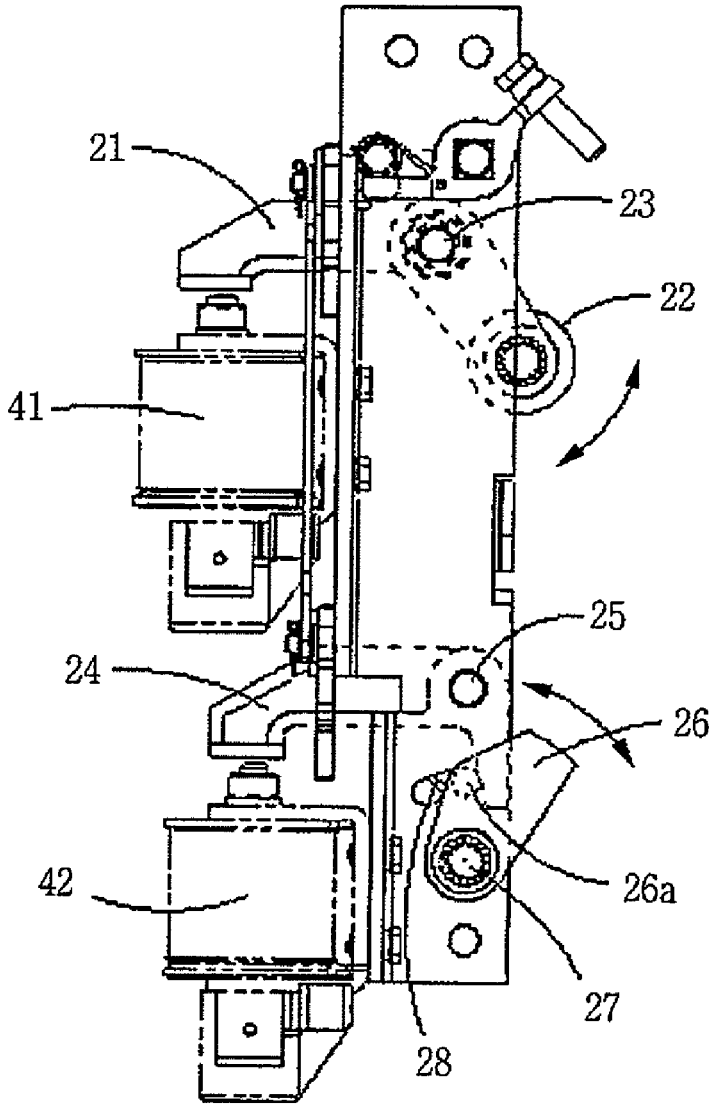
FIG. 2 is a side view showing in detail the structure of a closing lever, a closing latch, a trip lever and a trip latch of the vacuum circuit breaker of FIG. 1.
Figure 3:
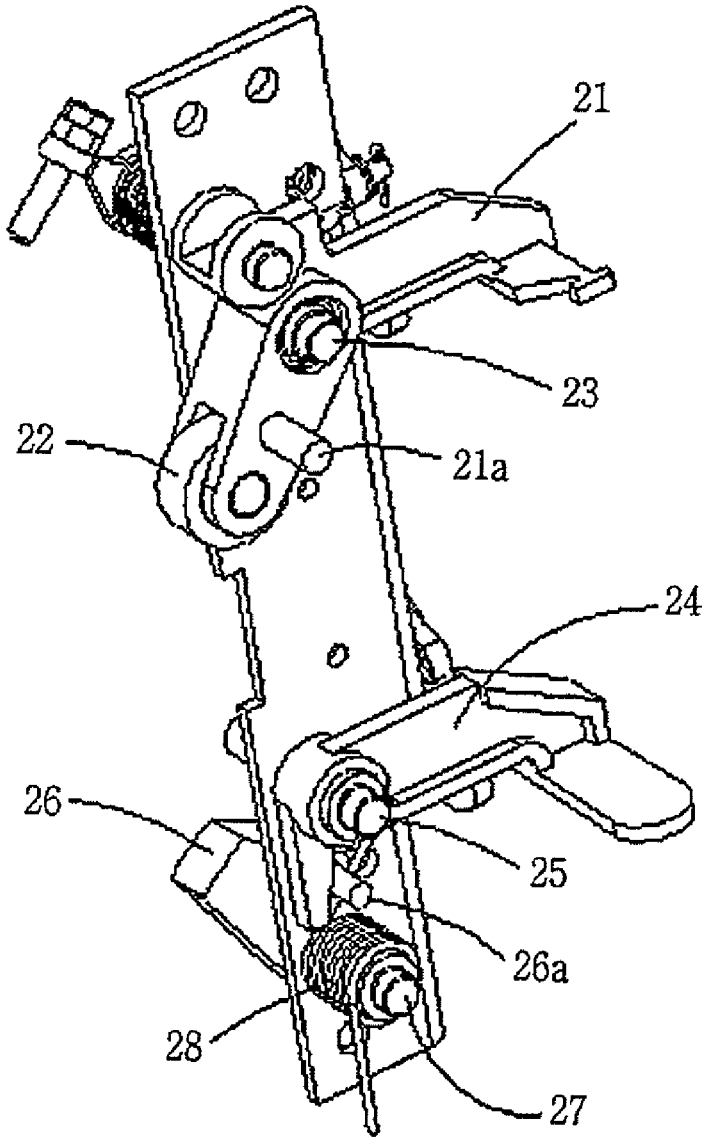
FIG. 3 is a perspective view showing in detail the three-dimensional structures of the closing lever, the closing latch, the trip lever and the trip latch of the vacuum circuit breaker of FIG. 2.

In the meantime, FIG. 2 is a side view showing in detail the structures of a closing lever, a closing latch, a trip lever and a trip latch of the vacuum circuit breaker of FIG. 1, and FIG. 3 is a perspective view inclinedly showing a rear surface of FIG. 2 to show in detail the three-dimensional configuration of the closing lever, the closing latch, the trip lever and the trip latch of the vacuum circuit breaker of FIG. 2. With reference to FIGS. 2 and 3, description will be given of the configurations and operations of the closing lever, the closing latch, the trip lever and the trip latch of the vacuum circuit breaker.

In FIGS. 2 and 3, a closing latch 22 and a trip latch 26 are configured to be movable to a position of latching or release the closing spring and the trip spring, respectively, as described with reference to FIG. 1. When the closing spring is latched, the closing spring is maintained in a charged state of elastic energy for closing the vacuum circuit breaker. When the closing spring discharges the charged elastic energy, the vacuum circuit breaker performs a closing operation by using the discharged elastic energy. That is, in FIG. 1, the closing operation may be configured such that the movable contactor 10*d* within the vacuum interrupter of the main circuit section 10 is moved to a position coming in contact with the stationary contactor 10*c* via a power transfer rod (not shown) by the power transfer link 20*a*, which is rotated by the elastic energy discharged from the closing spring.

When the trip spring is latched, the trip spring is maintained in a charged sate of elastic energy for tripping, i.e., automatically breaking off the vacuum circuit breaker. When the trip spring discharges the charged elastic energy, the vacuum circuit breaker performs the trip operation by using the discharged elastic energy. That is, the trip operation may be configured such that the power transfer link 20*a* of FIG. 1 is rotated by the elastic energy discharged from the trip spring and the movable contactor within the vacuum interrupter of the main circuit section 10 is moved to a position separated from the stationary contactor via the power transfer rod (not shown).

Referring to FIGS. 2 and 3, a closing lever 21 is coaxially connected to a transfer shaft 23 together with the closing latch 22. Accordingly, a closing coil 41 positioned below the closing lever 21 is magnetized such that a movable core of the closing coil 41 pushes the closing lever 21 upwardly. Hence, the closing lever 21 is rotated in a clockwise direction in FIG. 2 and in a counterclockwise direction in FIG. 3. Accordingly, the closing latch 22 coaxially connected to the transfer shaft 23 is also rotated in the same directions, so as to release the closing spring (not shown), thereby allowing the trip operation to be performed. When the closing coil 41 is demagnetized, the force, which the movable core of the closing coil 41 pushes the closing lever 21 upwardly, is disappeared. The closing lever 21 is thusly rotated in a counterclockwise direction in FIG. 2 and in a clockwise direction in FIG. 3 by a torsion spring (no reference numeral given) so as to be returned to its original position. Accordingly, the closing latch 22 coaxially connected to the transfer shaft 23 is also returned to a position of latching the closing spring (not shown).

In FIGS. 2 and 3, based upon a rotation shaft 25, the trip lever 24 may have a portion facing a trip coil 42 positioned therebelow and a portion contacting a trip latch transfer shaft 26*a*. The trip latch transfer shaft 26*a* may be configured as a protrusion, which is integrally protruded from one side surface of a trip latch 26, and accommodated in a long hole (slot). Further, the trip latch transfer shaft 26*a* receives a biasing force from the trip lever 24 in one direction (e.g., a right direction I FIG. 3), and a biasing force in another direction (e.g., a left direction in FIG. 3) from a return spring 28 positioned therebelow. The trip latch 26 is rotatable about a trip latch rotation shaft 27, and receives a rotation force via the trip latch transfer shaft 26*a*.

Hence, the trip coil 42 positioned below the trip lever 24 is magnetized such that the movable core of the trip coil 42 pushes the trip lever 24 upwardly. The trip lever 24 is thusly rotated in a clockwise direction in FIG. 2 and in a counterclockwise direction in FIG. 3, so as to push the trip latch transfer shaft 26*a*. Accordingly, the trip latch 26 is rotated in a counterclockwise direction in FIG. 2 and in a clockwise direction in FIG. 3, so as to release the trip spring (not shown), thereby allowing the trip operation to be performed. When the trip coil 42 is demagnetized, the force, which the movable core of the trip coil 42 pushes the trip lever 24 upwardly, is disappeared, and the trip lever 24 is rotated by the return spring 28 (see FIGS. 2 and 3) in a clockwise direction in FIG. 3, thus to be returned to its original position. Accordingly, the trip latch 26 is also returned to a position of latching the trip spring (not shown) via the trip latch transfer shaft 26*a*.

Now, configuration and operation of an interlock apparatus for a move-out type circuit breaker in accordance with the preferred embodiment of the present invention will be described with reference to FIGS. 4 to 7.

Figure 5:
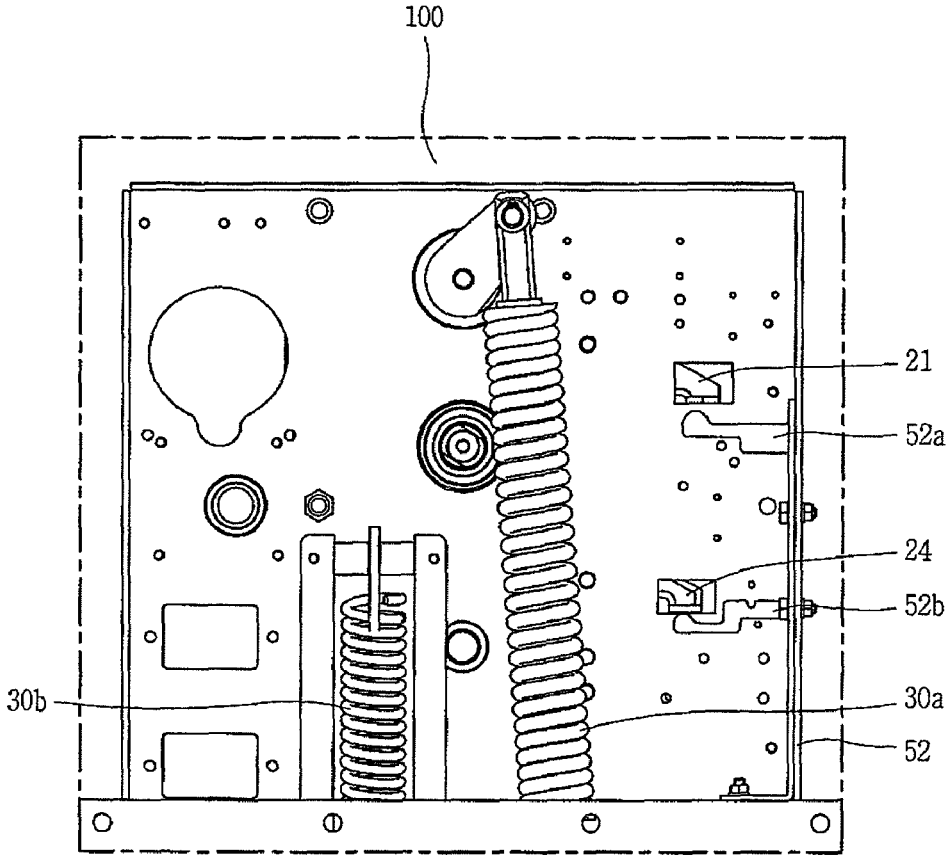
FIG. 5 is a rear view showing the configuration of the vacuum circuit breaker having the interlock apparatus according to the present invention.

First of all, description will be made of configuration and operation of a latching mechanism, a closing spring and a trip spring of the vacuum circuit breaker having the interlock apparatus according to the present invention, with reference to FIGS. 4 and 5.

The vacuum circuit breaker having the interlock apparatus according to the present invention is a move-out type vacuum circuit breaker having move-out position and move-in position. The move-out type vacuum circuit breaker, as shown in FIGS. 4 and 5, may include a closing spring 30*a*, a trip spring 30*b*, and a latching mechanism (i.e., including 21, 22, 24 and 26 to be explained later).

The closing spring 30*a* and the trip spring 30*b* may provide elastic energy for opening and closing a circuit.

The latching mechanism may be movable to a latching position of latching the closing spring 30*a* and the trip spring 30*b*, which then remain in a charged state, and a release position of releasing the closing spring 30*a* and the trip spring 30*b* to discharge the charged elastic energy. The latching mechanism, as described with reference to FIGS. 2 and 3, may include the closing lever 21, the closing latch 22, the trip lever 24 and the trip latch 26. In FIGS. 4 and 5, a power transfer link mechanism (i.e., including 32*a*, 32*b*, 32*c* and 32*d* to be explained later) may transfer the elastic energy discharged from the closing spring 30*a* or the trip spring 30*b* to the movable contactor of the vacuum interrupter within the main circuit section 10 of FIG. 1 as a driving force for opening and closing a circuit. The trip latch 26 included in the latching mechanism may have a latching position at which it latches a power transfer mechanism to be explained later so as to maintain the closing spring 30*a* in the elastic energy charged state, and a release position at which it is driven by the automatic releasing mechanism to release the power transfer mechanism so as to allow the discharging of the closing spring 30*a*.

With reference to FIGS. 4 to 7, description will be made of a configuration of a move-out type interlock apparatus for a circuit breaker according to the present invention, an installation of an automatic releasing mechanism included in the interlock apparatus in the vacuum circuit breaker, a relative configuration between the automatic releasing mechanism and the latching mechanism, and a configuration of a power transfer mechanism.

Figure 6:
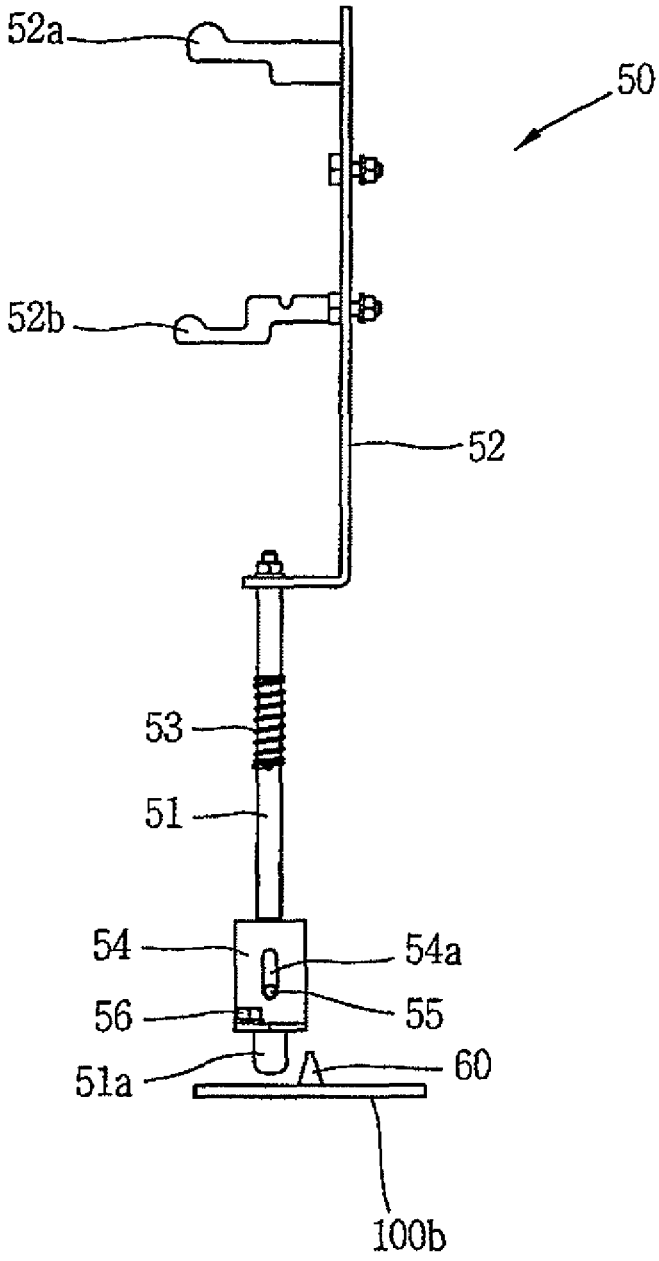
FIG. 6 is a side view separately showing the interlock apparatus for the circuit breaker according to the present invention.

A interlock apparatus for a circuit breaker according to the present invention, as shown in FIG. 6, may include a releasing protrusion member 60, and an automatic releasing mechanism 50.

The releasing protrusion member 60 may be fixed to a predetermined position to be protruded upwardly on a moving-out or moving-in path of the vacuum circuit breaker. In this embodiment, in order to cooperate with the automatic releasing mechanism 50, the releasing protrusion member 60 may be fixed to a predetermined position to be upwardly protruded on a bottom surface 100*b* of an outer case (e.g., a bottom surface of an outer case of a power distributing board), in which the vacuum circuit breaker is disposed. The predetermined position may be on a path, on which a portion (refer to 51*a* of FIG. 6) of the automatic releasing mechanism 50, contactable with the releasing protrusion member 60, is moved upon moving-in the vacuum circuit breaker.

If it is assumed that the vacuum circuit breaker 100 has relative positions, with respect to the outer case of the power distributing board, divided into a moving-in position at which it is connected to a power source circuit terminal and an electrical load circuit terminal, a test position at which it is separated from the power source circuit terminal and the electrical load circuit terminal and only is provided with control power for testing, and a moving-out position at which it is separated from the power source and electrical load circuit terminals and the control power supply is also broken off, preferably, the releasing protrusion member 60 may be disposed at a position, adjacent to a position of the corresponding portion of the automatic releasing mechanism 50 when the vacuum circuit breaker 100 is positioned at the moving-in position, on the bottom surface 100*b* of the outer case (e.g., the bottom surface of the outer case of the power distributing board), in which the vacuum circuit breaker 100 is disposed. Accordingly, the interlock apparatus is driven at the beginning of moving-out (pulling out) the vacuum circuit breaker or just before completely moving-in (pushing in) the vacuum circuit breaker, so as to allow the closing spring or trip spring to discharge elastic energy, thereby protecting a user safely.

Preferably, the releasing protrusion member 60, as shown in FIG. 6, may have a slant surface so as to smoothly come in contact with the corresponding portion of the automatic releasing mechanism 50. Preferably, the slant surface may be configured to allow a smooth contact with the corresponding portion of the automatic releasing mechanism 50 in both directions, namely, a direction in which the vacuum circuit breaker is moved in (particularly, a direction in which the automatic releasing mechanism 50 is moved) for the connection to the power source and electrical load circuit terminals in the power distributing board and a direction in which the vacuum circuit breaker is pulled out (particularly, a direction in which the automatic releasing mechanism 50 is moved) for testing, examining and replacing the vacuum circuit breaker. Therefore, the releasing protrusion member 60 may be formed in a triangular prism laid down and fixed in a horizontal direction.

The automatic releasing mechanism 50, as shown in FIGS. 4 and 6, may be supported at the vacuum circuit breaker 100 to be movable in a vertical direction. In more detail, the automatic releasing mechanism 50 may be supported by a supporting bracket 54 in a shape of "U" fixed onto a support frame 100*a* positioned at a lower portion of the vacuum circuit breaker 100 by a fixing member, such as a fixing screw (see 56 of FIG. 6). The supporting bracket 54 in the shape of "U" may be provided with a fixing flange at its lower end and a through hole (no reference numeral given) formed through an upper portion thereof for allowing a vertical movement of a target to be supported. The automatic releasing mechanism 50, as shown in FIG. 6, may come in contact with the releasing protrusion member 60 upon moving-in or moving-out the vacuum circuit breaker 100, to be moved up along the slant surface of the releasing protrusion member 60, thereby driving the latching mechanism shown in FIG. 4 toward the release position.

Figure 7:
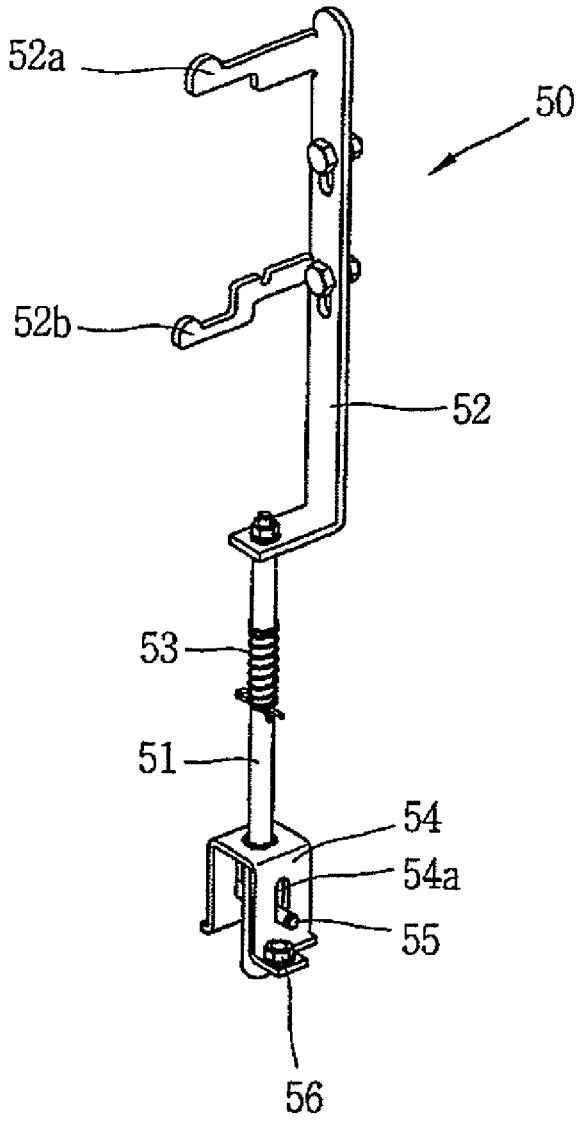
FIG. 7 is a perspective view separately showing the configuration of an automatic releasing mechanism of the interlock apparatus for the circuit breaker according to the present invention.
Figure 8:
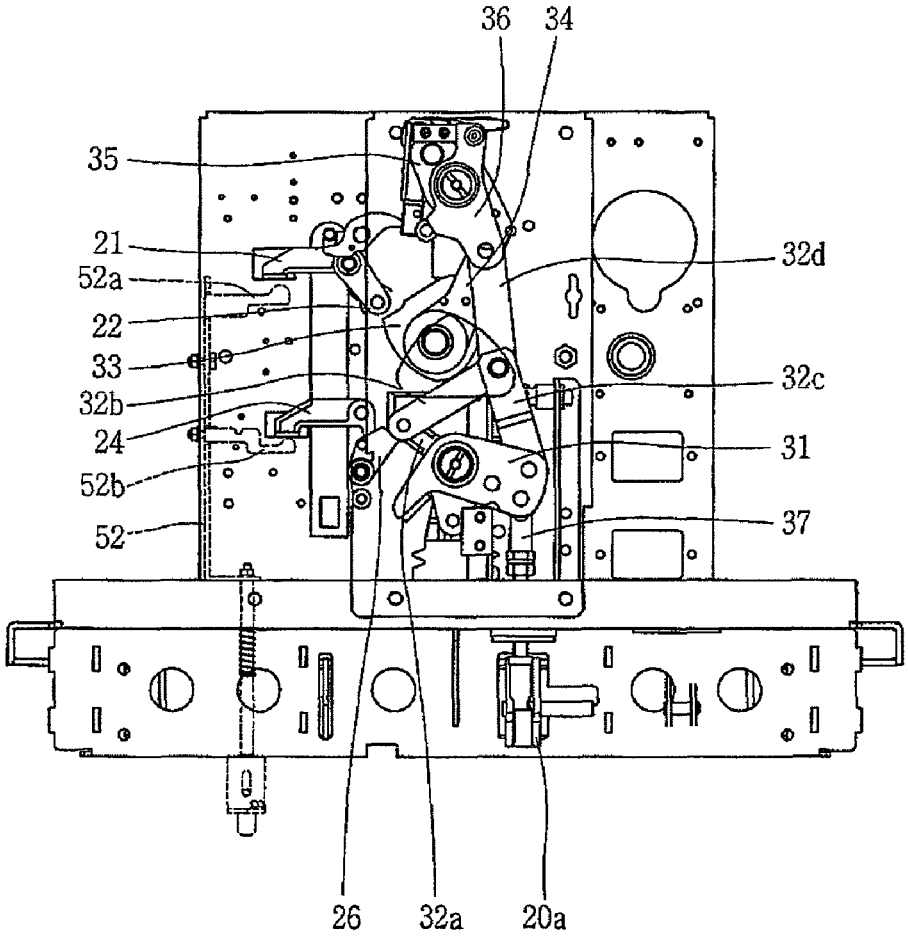
Figure 9:
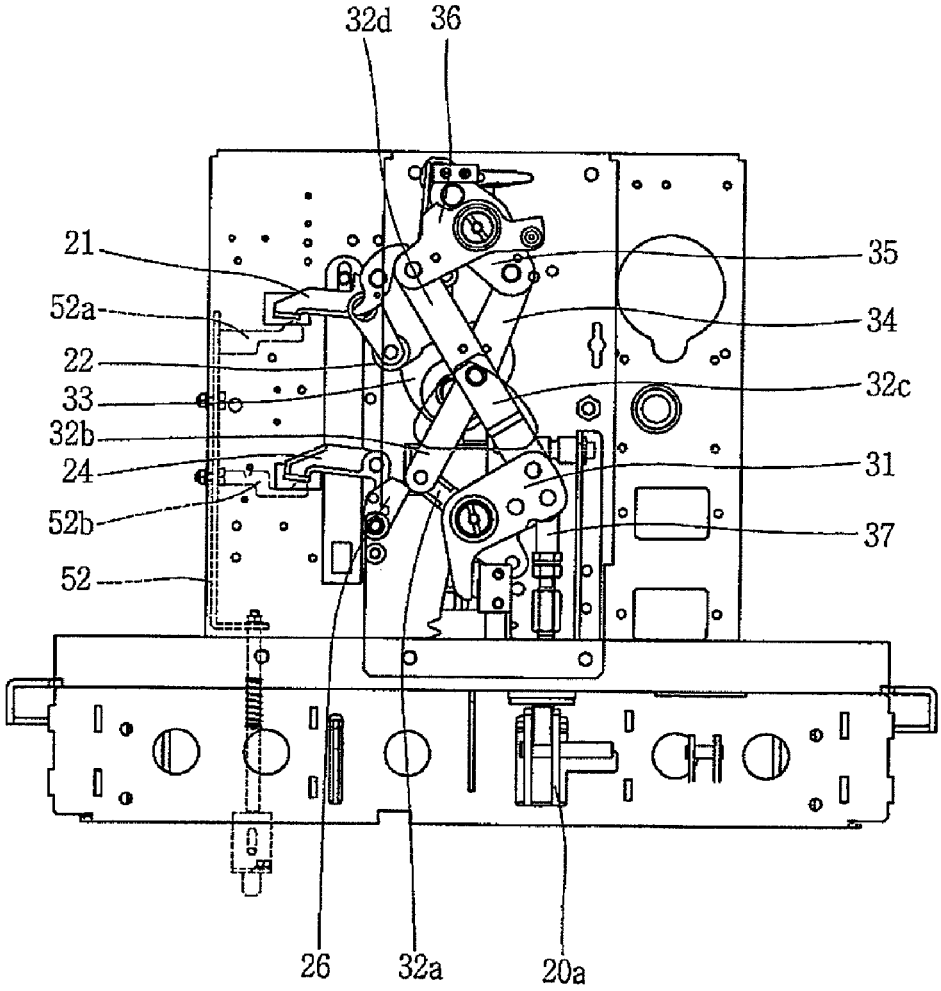

As well shown in FIGS. 6 and 7, the automatic releasing mechanism 50 may include an automatic releasing rod 51, and an automatic releasing lever 52.

The automatic releasing rod 51 is supported at the vacuum circuit breaker 100 to be movable in a vertical direction, and movable together with the vacuum circuit breaker 100 when the vacuum circuit breaker 100 is moved-in or moved-out. The automatic releasing rod 51 may have an ascent position to which the automatic releasing rod 51 has been moved up with coming in contact with the releasing protrusion member 60, and a descent position to which the automatic releasing rod 51 has been moved down upon no contact with the releasing protrusion member 60. The automatic releasing lever 52 may be connected to the automatic releasing rod 51. The automatic releasing lever 52 may have a contact position where it contacts the latching mechanism (see 21, 22, 24 and 26 of FIG. 4) upon the automatic releasing rod 51 being risen, so as to drive the latching mechanism to a release position, and a non-contact position where it is separated from the latching mechanism upon the automatic releasing rod 51 being lowered. A lower end surface of the automatic releasing rod 51 may preferably be formed to have a curved surface so as to smoothly come in contact with the releasing protrusion member 60.

The automatic releasing rod 51 may be provided with a supporting pin 55 integrally protruded in a horizontal direction from a position adjacent to the lower end surface formed to have the curved surface or separately formed to be then connected to the position in the horizontal direction. The supporting bracket 54 may be provided with a long hole 54*a* defining a limitation of a vertical movement of the supporting pin 55. Therefore, the automatic releasing rod 51 may be supported by the supporting pin 55, which is supported in the long hole 54*a* of the supporting bracket 54, so as to have the limitation of the vertical movement.

An upper portion of the automatic releasing rod 51 may extend upwardly in the vertical direction via a through hole formed through the upper portion of the supporting bracket 54. Preferably, a threaded surface is disposed at an upper end portion of the automatic releasing rod 51, and, referring to FIG. 7, the upper end portion having the screw thread of the automatic releasing rod 51 extends through a through hole disposed in correspondence with a lower end portion of the automatic releasing lever 52 curved in a shape of "L". A nut is coupled to the upper end portion with the screw thread of the automatic releasing rod 51, which extends through the through hole of the automatic releasing lever 52. Accordingly, the automatic releasing rod 51 and the automatic releasing lever 52 are all connected to each other so as to be movable together in the vertical direction.

The automatic releasing lever 52 may include a first latching mechanism contact portion (abbreviated first contact portion hereinafter) 52*b* and a second latching mechanism contact portion (abbreviated second contact portion hereinafter) 52*a*. The first contact portion 52*b* may come in contact with the latching mechanism (see 21, 22, 24 and 26 of FIG. 4), particularly, with the trip lever 24 for releasing the trip spring 30*b*. The second contact portion 52*a* may come in contact with the latching mechanism, particularly, with the closing lever 21. The second contact portion 52*a* may be positioned farther from the corresponding closing lever 21 of the latching mechanism, so as to come in contact with the closing lever 21, later than the first contact portion 52*b* coming in contact with the trip lever 24.

The first contact portion 52*b* and the second contact portion 52*a* of the automatic releasing lever 52 are implemented in the embodiment such that they are integrally formed with the automatic releasing lever 52. However, other embodiment may also be implemented such that the first and second contact portions 52*b* and 52*a* may be formed separately from the automatic releasing lever 52. Accordingly, the first and second contact portions 52*b* and 52*a* may be coupled to the automatic releasing lever 52 by a long hole formed at a predetermined position of the automatic releasing lever 52 in a vertical direction and bolt and nut for connecting the first and second contact portions 52*b* and 52*a* to the automatic releasing lever 52 via the long hole. The coupled position may be variable in the vertical direction.

The interlock apparatus for the circuit breaker according to the preferred embodiment of the present invention may further include a return spring 53 having one end connected to the automatic releasing rod 51 to be supported thereby, and another end supported by the vacuum circuit breaker 100, particularly, by the lower support frame 100*a*-1. The return spring 53 may be configured to return the automatic releasing rod 51 and the automatic releasing lever 52 to their descent position when the automatic releasing rod 51 does not contact the releasing protrusion member 60.

The interlock apparatus for the circuit breaker according to the present invention, as shown in FIG. 4, may further include a power transfer mechanism (including 37, 31, 32*a*, 32*b*, 32*c*, 32*d*, 35 and 36 to be explained later) which transfers a mechanical driving force for opening and closing a circuit from the closing spring 30*a* or the trip spring 30*b* to the movable contactor of the vacuum circuit breaker 100.

A vertically movable shaft 37 included in the power transfer mechanism may be connected to the trip spring 30*b* and movable in a vertical direction. Also, the vertically movable shaft 37 may be connected to one end of the power transfer link 20*a* described with reference to FIG. 1 by a connection pin 38 to be vertically moved. In cooperation with the vertical movement, the power transfer link 20*a* connected to the vertically movable shaft 37 is rotated so as to open or close the movable contactor of the vacuum interrupter via the power transfer rod of the main circuit section 10 connected to another end of the power transfer link 20*a*.

A first rotation lever 31 included in the power transfer mechanism may have one end portion connected to the vertically movable shaft 37, and configured to be rotatable. In detail, the first rotation lever 31 may be rotatably supported by a rotation shaft, which is installed to be rotatable only with the first rotation lever 31 in place. A lower portion of the one end portion of the first rotation lever 31 is connected to the vertically movable shaft 37 so as to be rotated in cooperation with the vertically movable vertically movable shaft 37. An upper portion of the one end portion of the first rotation lever 31 is connected to a link mechanism (including 32*a*, 32*b*, 32*c* and 32*d* to be explained later), in more detail, to a third link member 32*c* of the link mechanism.

The link mechanism may include a first link member 32*a*, a second link member 32*b*, a third link member 32*c* and a fourth link member 32*d*.

The first link member 32*a* may preferably be configured as a metallic member in a shape of rod, which has a comparatively narrow width and a length shorter than those of other link members. One end portion of the first link member 32*a* may be coaxially connected to the rotation shaft, and another end portion of the first link member 32*a* may be connected to the second link member 32*b* by a connection pin (no reference numeral given).

The second link member 32*b* may be configured as a metallic member in a shape of rod with a narrow width and a length longer than that of the first link member 32*a*. A lower end portion of the second link member 32*b* may be connected to the first link member 32*a*, and an upper end portion of the second link member 32*b* may be connected commonly to an upper end portion of the third link member 32*c* and to a lower end portion of the fourth link member 32*d* by connection pins (no reference numeral given).

The third link member 32*c* may be configured as a metallic member in a shape of rod with a narrow width and a length shorter than that of the first link member 32*a*. The lower end portion of the third link member 32*c* may be connected to the first rotation lever 31 and an upper end portion of the third link member 32*c* may be connected, commonly to the upper end portion of the second link member 32*b* and the lower end portion of the fourth link member 32*d* by the connection pin.

The fourth link member 32*d* may be configured as a metallic member in a shape of rod with a narrow width and a length longer than that of the first link member 32*a*. The lower end portion of the fourth link member 32*d* may be connected commonly to the upper end portion of the second link member 32*b* and the upper end portion of the third link member 32*c*, and the upper end portion of the fourth link member 32*d* may be connected to one end portion of a second rotation lever 36.

The second rotation lever 36 included in the power transfer mechanism may be rotatable about a rotation shaft fixed to a position in a vertical or horizontal direction to prevent the movement in the vertical or horizontal direction. One end portion of the second rotation lever 36 may be connected to the upper end portion of the fourth link member 32*d*.

In FIG. 4, a return spring (not shown) may preferably be disposed, having one end portion fixedly supported by an upper portion of a right side of a supporting plate (i.e., a square portion represented by a dot line in FIG. 4), which supports the switching mechanism, and the other end portion connected to the second rotation lever 36, such that the second rotation lever 36 can receive an elastic force from the return spring to thusly return to its original position.

A closing spring supporting lever 35 included in the power transfer mechanism may have one end portion connected to the closing spring 30*a*, and coaxially connected to a rotation shaft of the second rotation lever 36. The other end portion of the closing spring supporting lever 35 may be connected to a crank shaft 33 via a crank connection lever 34.

In cooperation of the closing spring 30*a* being charged with elastic energy, i.e., in cooperation of the operation that the closing spring is tensioned to be moved to a position where elastic energy is charged, the closing spring supporting lever 35 rotates in a clockwise direction in FIG. 4.

In cooperation of the closing spring 30*a* being discharged, i.e., in cooperation of the operation that the closing spring 30*a* is contracted to be moved to discharge the elastic energy, the closing spring supporting lever 35 is rotated in a counterclockwise direction in FIG. 4. The clockwise rotation of the closing spring supporting lever 35 may cause the crank connection lever 34 connected thereto to be moved (pushed) down, and the counterclockwise rotation of the closing spring supporting lever 35 may cause the crank connection lever 34 to be moved (pulled) up. As the crank connection lever 34 is moved up and down, the crank shaft 33 connected to the crank connection lever 34 is rotated.

Hereinafter, an operation of the interlock apparatus for the circuit breaker according to the present invention having such configuration will be described with reference to FIGS. 1 to 18.

Upon moving-in or moving-out the move-out type vacuum circuit breaker 100 according to the present invention, the automatic releasing rod 51 disposed at the lower portion of the vacuum circuit breaker 100 comes in contact with the slant surface of the releasing protrusion member 60, which is fixed to the predetermined position on the bottom surface 100*b* of the outer case of the power distributing board having the vacuum circuit breaker 100 therein. Accordingly, the automatic releasing rod 51 and the automatic releasing lever 52 are moved upwardly.

As the automatic release lever 52 is moved upwardly, the first contact portion 52*b* and the second contact portion 52*a* of the automatic release lever 52 pressurize the corresponding trip lever 24 and the closing lever 21, respectively, thus to rotate them in a clockwise direction in the drawing. Here, a distance between the second contact portion 52*a* and the closing lever 21 is farther than a distance between the first contact portion 52*b* and the trip lever 24, the first contact portion 52b comes in contact with the trip lever 24 earlier than the second contact portion 52*a* coming in contact with the closing lever 21. Hence, in FIG. 4, the trip lever 24 is rotated in the clockwise direction earlier than the closing lever 21 being rotated in the clockwise direction.

Accordingly, the trip latch 26 is rotated in a counterclockwise direction by the trip lever 24 having rotated first, thereby releasing the trip link 31. The closing latch 22, coaxially connected to the closing lever 21, is also rotated in the clockwise direction in FIG. 4 by the closing lever 21 having rotated in the clockwise direction, thereby releasing the crank shaft 33. The succeeding operation may be executed differently depending on the following four initial conditions.

First, description will be made of an operation performed under the condition that the vacuum circuit breaker 100 is closed (i.e., ON state), and the closing spring 30*a* is charged.

Figure 10:
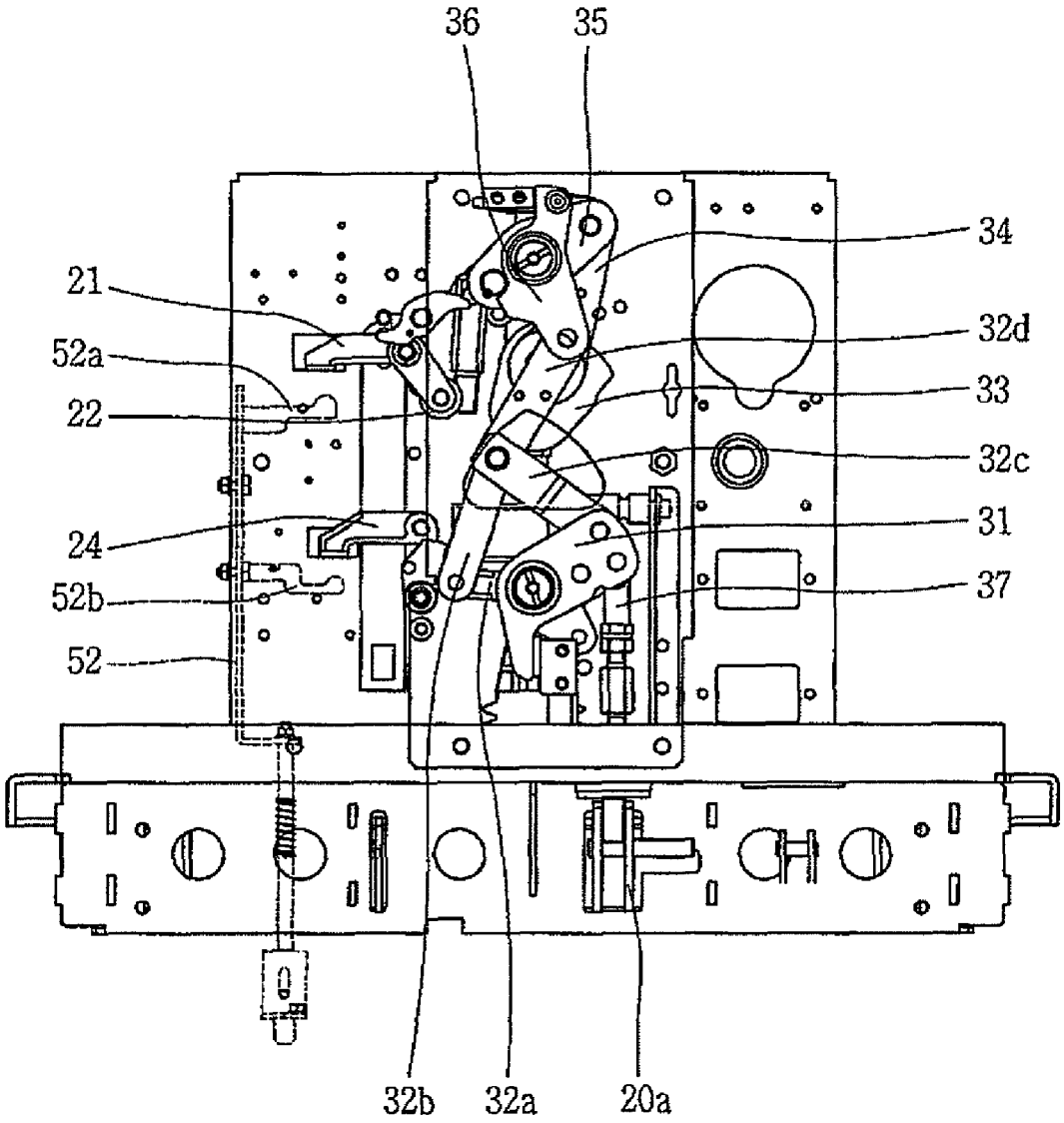

As the trip latch 26 is rotated in the counterclockwise direction by the firstly rotated trip lever 24, the second link member 32*b* is released so as to be moved down. Here, the trip spring 30*b* is contracted into its original state to thusly discharge the charged elastic energy. Upon being contracted, the trip spring 30*b* pulls up the vertically movable shaft 37 connected to the lower end portion thereof. As the vertically movable shaft 37 is pulled up, the power transfer link 20*a* is rotated in the clockwise direction in FIG. 1. The movable contactor 10*d* within the vacuum interrupter of the main circuit section 10 is thusly separated from a stationary contactor 10*c*, thereby tripping (opening) the vacuum circuit breaker 100. Then, the closing spring 30*b* is contracted by the released closing lever 21 and the closing latch 22, which have been operated later, thereby discharging the charged elastic energy. The closing spring supporting lever 35 is thusly rotated in the counterclockwise direction as shown in FIG. 10. The crank connection lever 34 connected to the closing spring supporting lever 35 is then risen in cooperation with the counterclockwise rotation of the closing spring supporting lever 35. The crank shaft 33 connected to the crank connection lever 34 is thusly rotated in the counterclockwise direction. Therefore, as shown in FIG. 10, the tripped state (i.e., open (OFF) state) is maintained in a state where only the elastic energy charged in the closing spring 30*a* is discharged.

Figure 11:
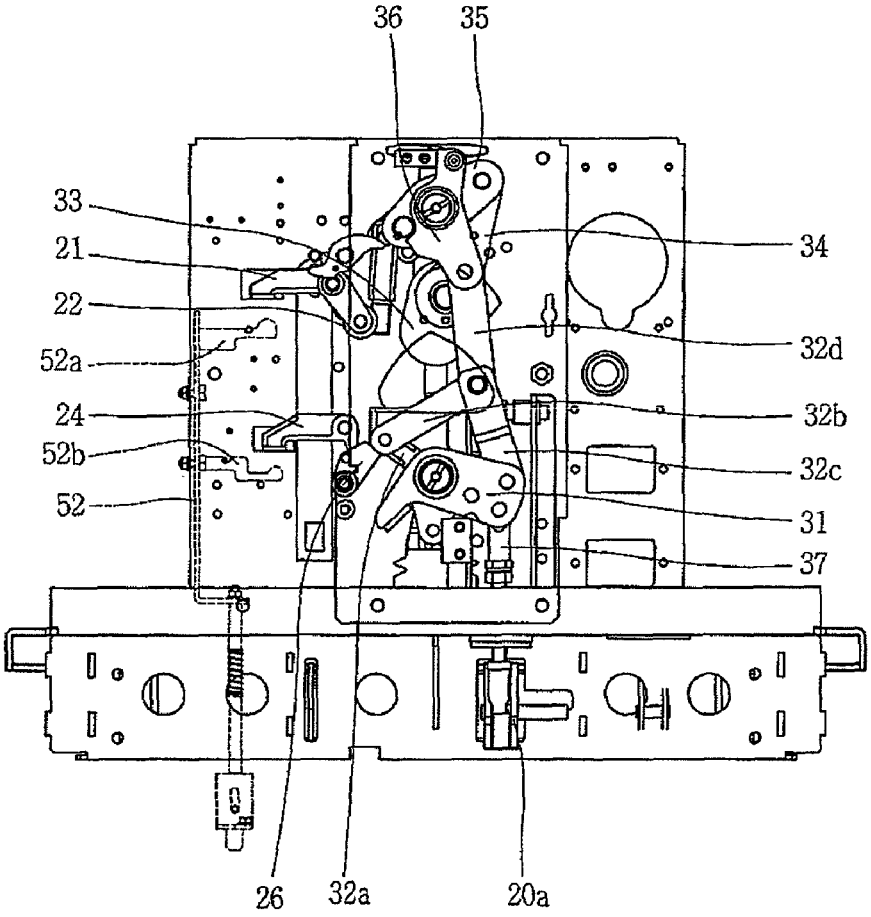
Figure 12:
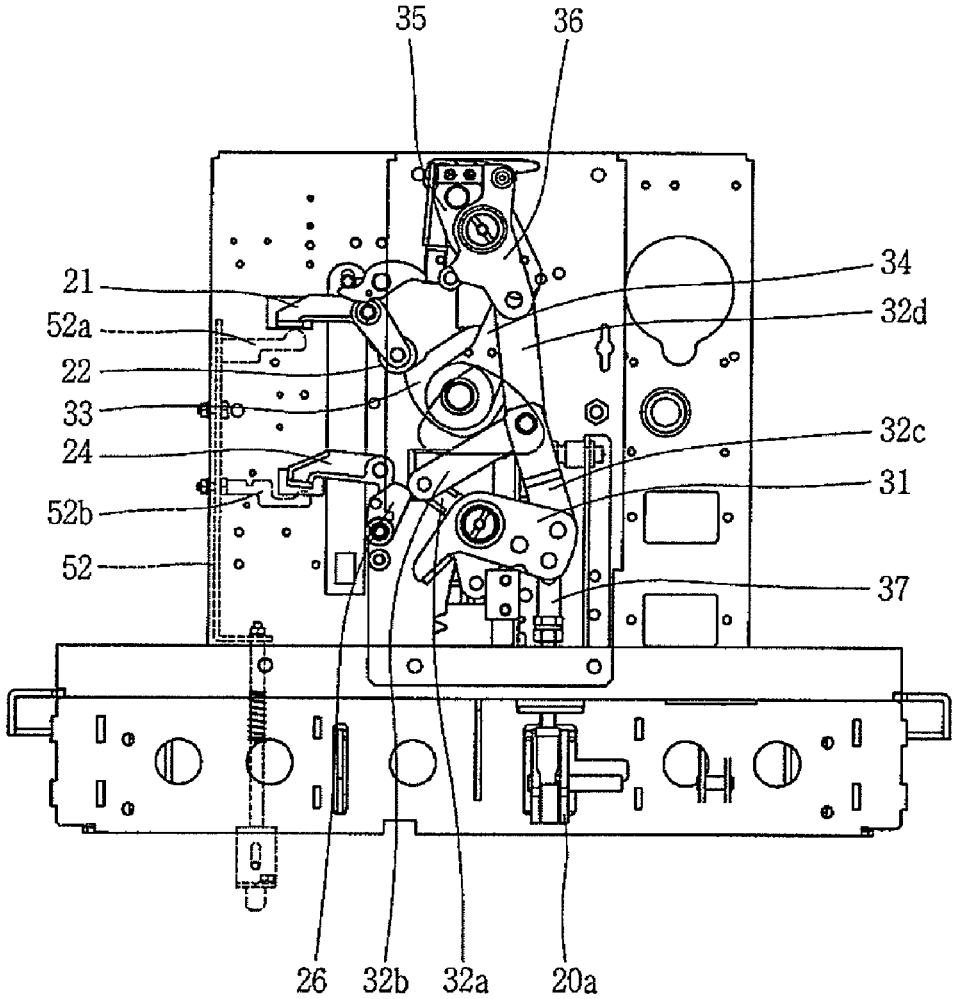
Figure 13:
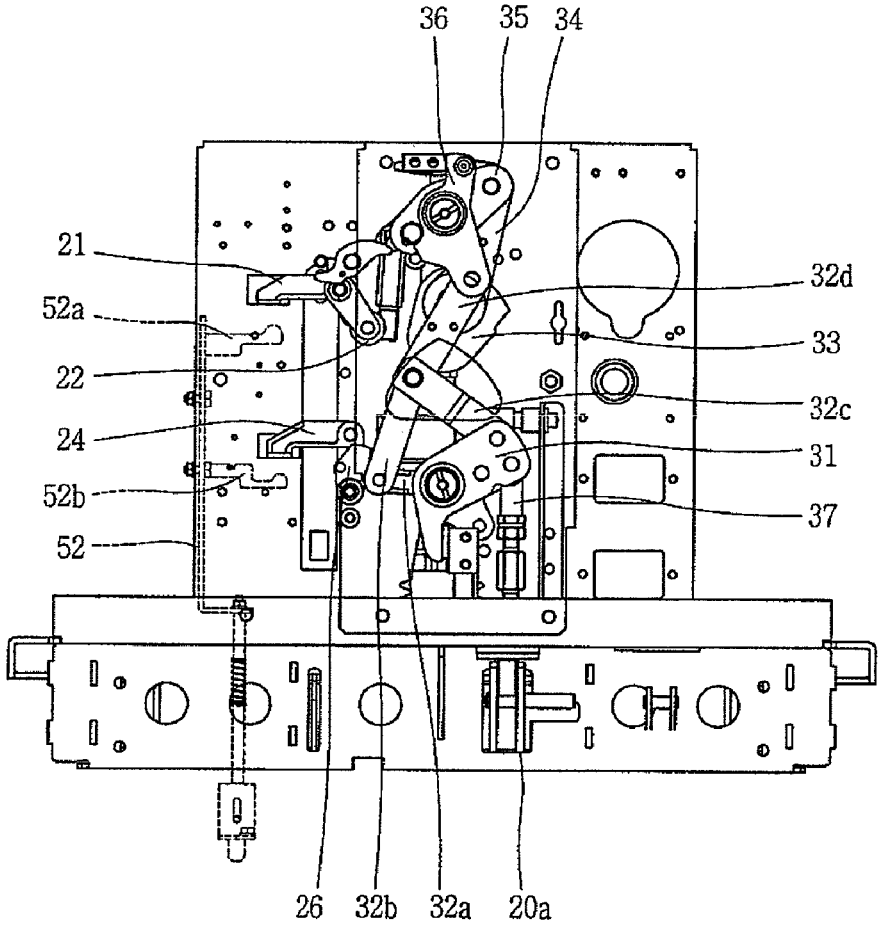
Figure 14:
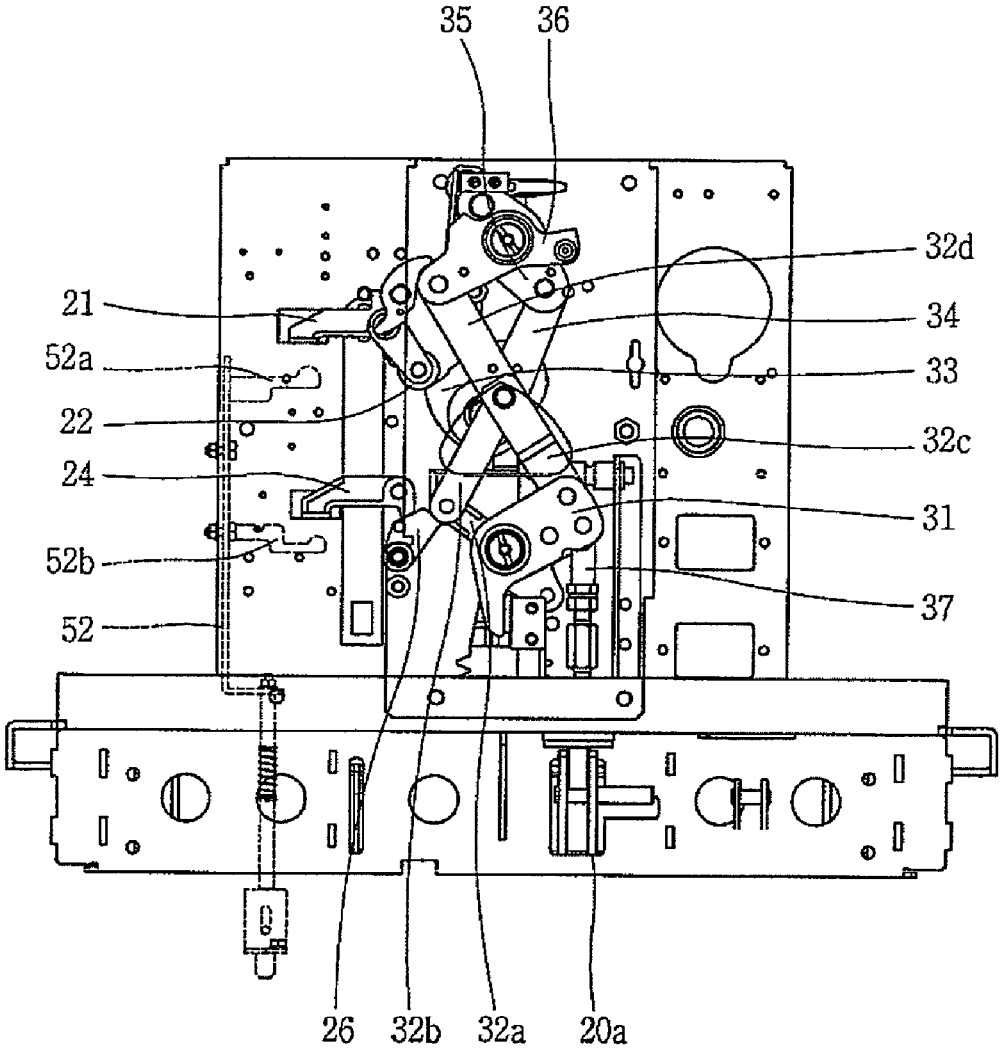
Figure 15:
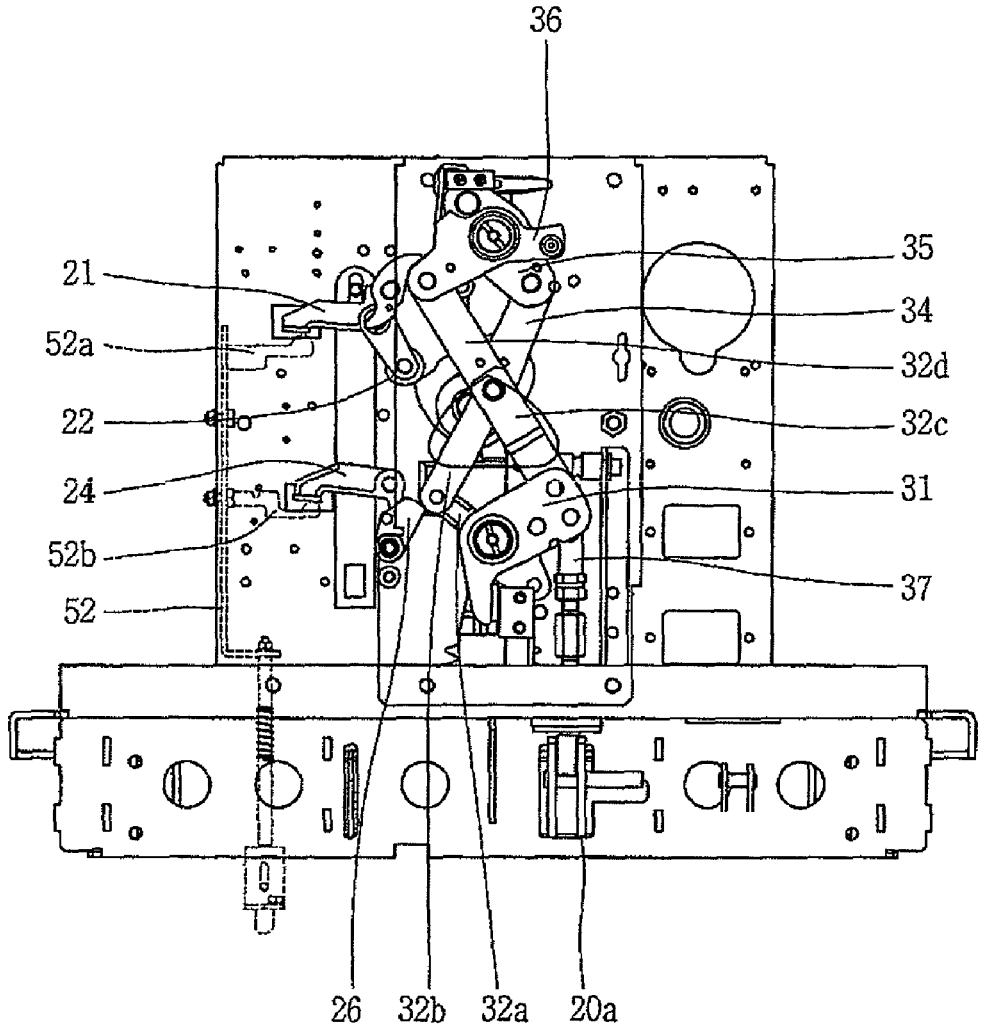
Figure 16:
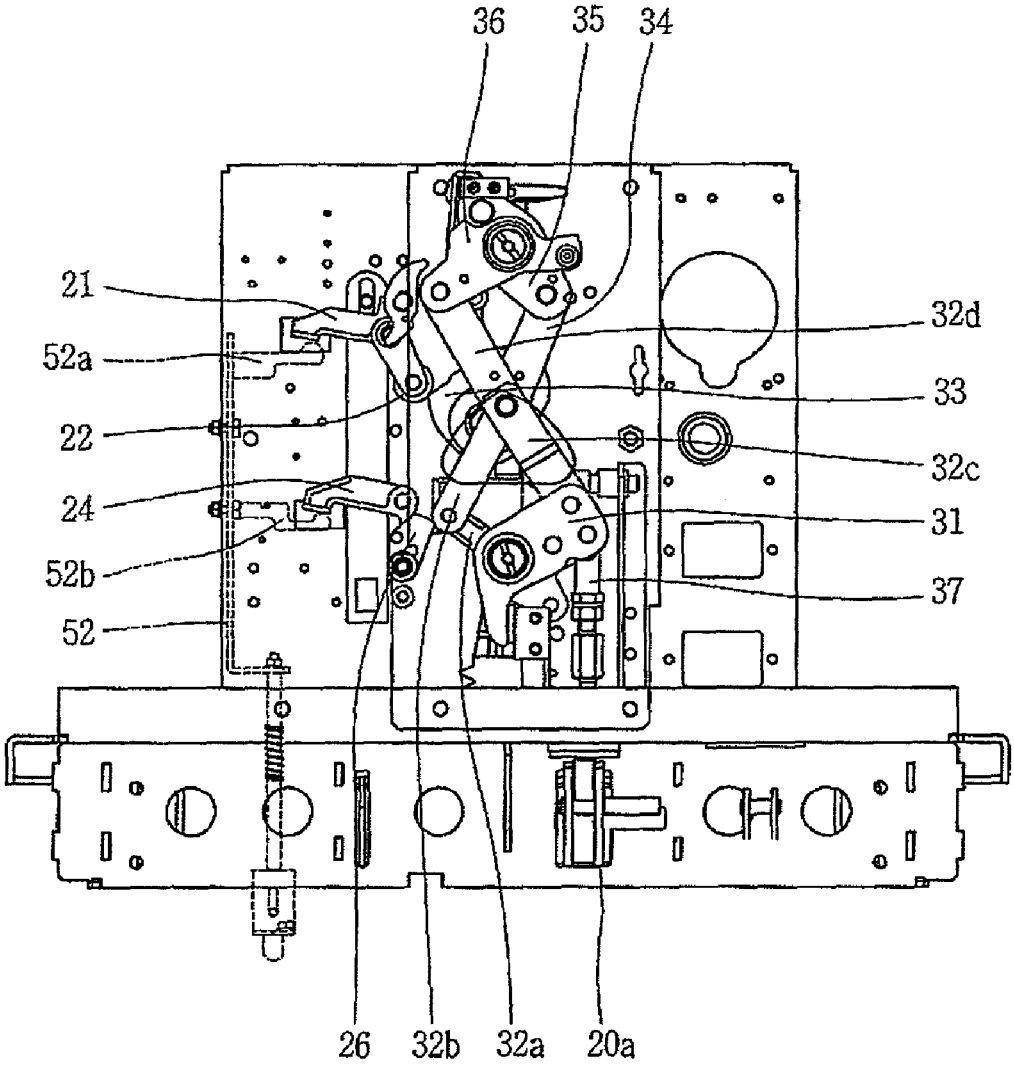

Second, description will be made of an operation performed under the condition that the vacuum circuit breaker 100 is closed (i.e., ON state) and the closing spring 30*a* is discharged, with reference to FIGS. 11 to 13.

As the trip latch 26 releases the second link member 32*b* in association with the firstly rotated trip lever 24, the second link member 32*b* is moved down. Here, the trip spring 30*b* is contracted into its original state so as to discharge the charged elastic energy. Upon being contracted, the trip spring 30*b* pulls up the vertically movable shaft 37 connected to the lower end portion thereof. As the vertically movable shaft 37 is pulled up, the power transfer link 20*a* is rotated in the clockwise direction in FIG. 1. Accordingly, the movable contactor 10*d* within the vacuum interrupter of the main circuit section 10 is separated from the stationary contactor 10*c*, thereby tripping (opening) the vacuum circuit breaker100 as shown in FIG. 13. Then, the crank shaft 33 is rotated by the released closing lever 21 and the closing latch 22, which have been rotated latter. However, since the closing spring 30*a* is in the discharged state, the closing operation is not performed. Therefore, the vacuum circuit breaker 100 is maintained in the tripped state (open (OFF) state) as shown in FIG. 13.

Third, description will be made of an operation performed under the condition that the vacuum circuit breaker 100 is tripped (i.e., OFF state) and the closing spring 30*a* is charged, with reference to FIGS. 14 to 17.

Figure 17:
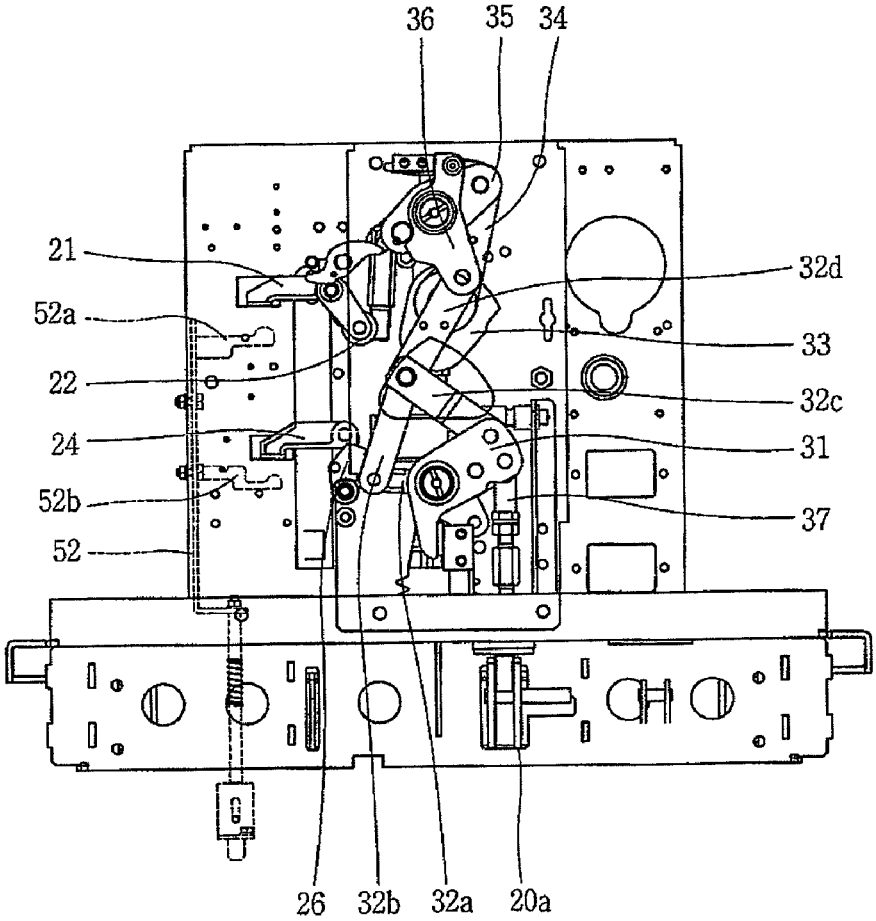

As the trip latch 26 releases the second link member 32*b* by the firstly operated trip lever 24, the second link member 32*b* is moved down. Since the vacuum circuit breaker 100 is already in the tripped state, the trip spring 30*b* is in a state of already discharging elastic energy, namely, in a contracted state. Accordingly, the vertically movable shaft 37 connected to the lower end portion of the trip spring 30*b* remains in the ascended state (i.e., the state of being pulled up). Also, since the power transfer link 20*a* is already rotated in the clockwise direction in FIG. 1, the movable contactor within the vacuum interrupter of the main circuit section 10 in FIG. 1 is separated from the stationary contactor, such that the vacuum circuit breaker 100 is maintained in the tripped state (i.e., OFF state) as shown in FIGS. 14 to 17. Afterwards, the crank shaft 33 is rotated in the counterclockwise direction, as shown in FIG. 17, due to the release of the latter rotated closing lever 21 and closing latch 22. As the closing spring 30*a* discharges the charged elastic energy, the closing spring supporting lever 35 is rotated in the counterclockwise direction as similar in FIG. 10. In cooperation with the counterclockwise rotation of the closing spring supporting lever 35, the crank connection lever 34 connected to the closing spring supporting lever 35 is moved up. Here, since the second link member 32*b* has been released by the firstly rotated trip lever 24 and trip latch 26 to be moved down, the tripped state (i.e., OFF state) is maintained in the state where the power transfer mechanism is not moved to the closing position (ON position) and only the elastic energy charged in the closing spring 30*a* is discharged.

Figure 18:
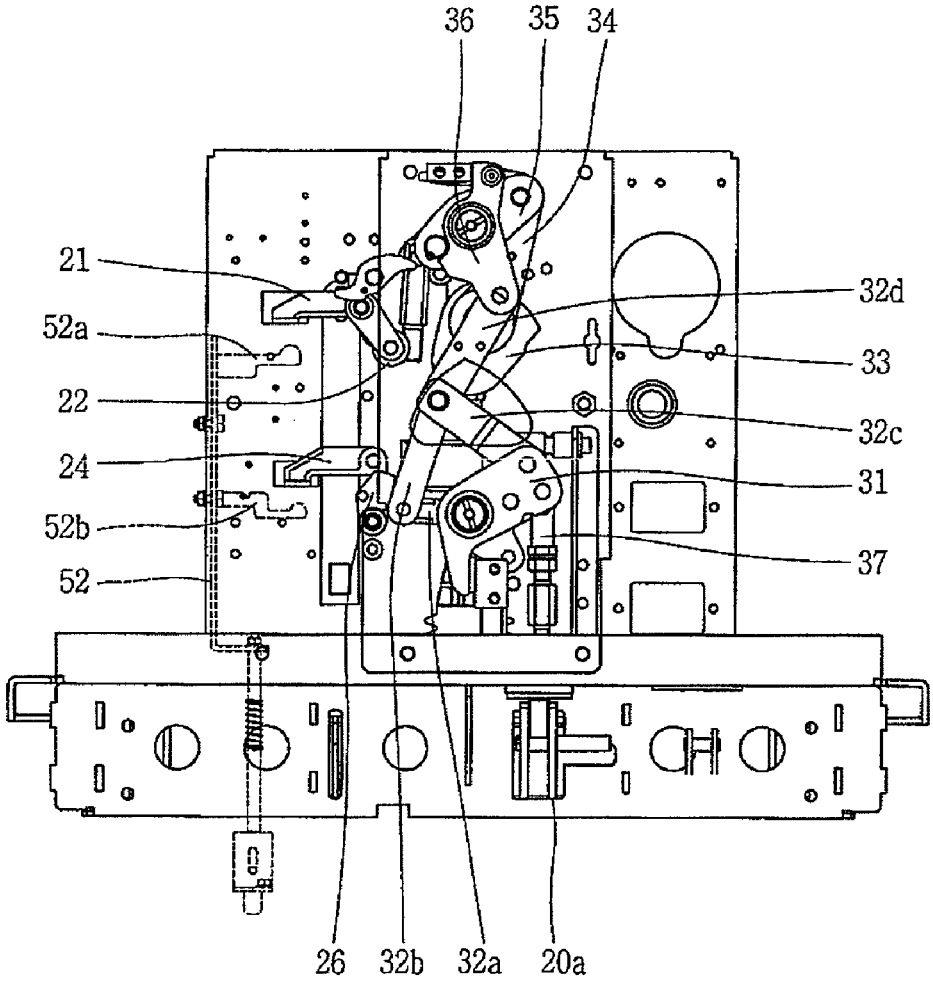

Fourth, description will be made of an operation performed under the condition that the vacuum circuit breaker 100 is tripped (i.e., OFF state) and the closing spring 30*a* is discharged, with reference to FIG. 18.

The trip latch 26 releases the trip link 31 by the firstly operated trip lever 24. However, as shown in FIG. 18, the second link member 32*b* is already moved down. That is, the vacuum circuit breaker 100 is already in the tripped state, and the trip spring 30*b* is also already discharged, namely, in the contracted state. Accordingly, the vertically movable shaft 37 connected to the lower end portion of the trip spring 30*b* remains in the state of being pulled up. Also, since the power transfer link 20*a* has been rotated in the clockwise direction in FIG. 1, the movable contactor 10*d* within the vacuum interrupter of the main circuit section 10 in FIG. 1 is separated from the stationary contactor 10*c*, such that the vacuum circuit breaker 100 is maintained in the tripped state (i.e., OFF state) as shown in FIGS. 14 to 17.

Afterwards, the crank shaft 33 is rotated in the counterclockwise direction, as shown in FIG. 17, due to the release of the firstly operated closing lever 21 and closing latch 22. However, since the closing spring 30*a* has already discharged the elastic energy, the closing spring supporting lever 35 is not moved. Therefore, the crank connection lever 34 connected to the closing spring supporting lever 35 is not moved as well.

Hence, in the state where the vacuum circuit breaker 100 is tripped (i.e., OFF state) and the closing spring 30*a* has discharged the elastic energy, upon pushing in or pulling out the vacuum circuit breaker 100, even if the automatic releasing rod 51 disposed at the lower portion of the vacuum circuit breaker 100 comes in contact with the slant surface of the releasing protrusion member 60, which is fixed to the predetermined position on the bottom surface 100*b* of the outer case of the distributing board having the vacuum circuit breaker 100 therein, such that the automatic releasing rod 51 and the automatic releasing lever 52 are moved up, the power transfer link 20*a* connected to the power transfer mechanism at its rear end and the vacuum interrupter of the main circuit section 10 remain in the tripped state without being moved.

As described above, in the move-out type interlock apparatus for a circuit breaker according to the present invention, when the move-out type circuit breaker is pushed in the outer case, such as the distributing board, or pulled out of the outer case, the elastic energy charged in the closing spring is automatically discharged and simultaneously the vacuum circuit breaker is tripped (i.e., open), thereby protecting users safely.

Further, in the move-out type interlock apparatus for the circuit breaker according to the present invention, a distance between the second contact portion 52*a* and the closing lever 21 is configured to be farther than a distance between the first contact portion 52*b* and the trip lever 24, such that the first contact portion 52*b* comes in contact with the trip lever 24 earlier than the second contact portion coming in contact with the closing lever 21. Hence, the trip latch first releases the link mechanism (32*a*, 32*b*, 32*c*, and 32*d*), and accordingly the link mechanism is allowed to drive the circuit breaker only to the trip position with being disabled to drive the circuit breaker to the closing position, resulting in enabling more reliable user protection.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A interlock apparatus for a move-out type circuit breaker, the circuit breaker including a closing spring and a trip spring each storing elastic energy for opening and closing a circuit, and a latching mechanism movable to a latching position where the closing spring and the trip spring are latched so as to remain in a charged state and a release position where the closing spring and the trip spring are released to discharge the stored elastic energy, the circuit breaker further having a move-out position and a move-in position, the interlock apparatus comprising:

a release protrusion fixed at a predetermined position to protrude upwardly on a path to move-out or move-in the circuit breaker; and an automatic release mechanism supported at the circuit breaker to be vertically movable, and configured to be moved up by contacting with the release protrusion upon moving-in or moving-out the circuit breaker to thereby drive the latching mechanism to the release position, wherein the automatic release mechanism comprises:

an automatic release rod supported at the circuit breaker to be vertically movable, the automatic release rod being movable together with the circuit breaker when the circuit breaker is moved-in or moved-out, and having an ascent position of being moved up by contacting the release protrusion and a descent position of being moved down upon not contacting the release protrusion; and an automatic release lever connected to the automatic release rod, and having a contact position where the automatic release lever comes into contact with the latching mechanism upon the automatic release rod being moved up so as to drive the latching mechanism to the release position, and a non-contact position where the automatic release lever is separated from the latching mechanism upon the automatic release rod being moved down.

2. The apparatus of claim 1, wherein the release protrusion has a slanted surface.

3. The apparatus of claim 1, wherein the release protrusion is located at a predetermined position on a bottom surface of an outer case of the circuit breaker, the predetermined position being contactable with the automatic release mechanism when the circuit breaker is moved-in or moved-out.

4. The apparatus of claim 1, wherein the move-out type circuit breaker is disposed within a power distributing board, wherein the release protrusion is fixedly installed at a predetermined position to protrude upwardly on a bottom surface of the distributing board along a move-in or move-out path of the move-out type circuit breaker.

5. The apparatus of claim 1, wherein the automatic release lever comprises:

a first contact portion contactable with the latching mechanism to release the trip spring; and a second contact portion disposed farther from the latching mechanism, compared to the first contact portion, to thus come in contact with the latching mechanism later than the first contact portion does, to release the closing spring.

6. The apparatus of claim 1, wherein the automatic release mechanism further comprises:

a return spring connected to the automatic release rod, and configured to return the automatic release rod and the automatic release lever to the descent position when the automatic release rod does not come in contact with the release protrusion.

7. The apparatus of claim 1, wherein a lower end surface of the automatic release rod is configured to have a curved surface.

8. The apparatus of claim 1, wherein the automatic release mechanism further comprises:

a supporting bracket fixed to the circuit breaker, and configured to support the automatic release rod to be vertically movable.

9. The apparatus of claim 8, wherein the automatic release rod is provided with a supporting pin protruded from a lower portion of the automatic release rod in a horizontal direction, wherein the supporting bracket is provided with an elongated hole for defining a vertical movement distance of the supporting pin.

* * * * *